US007698865B2

(12) United States Patent
Pringle et al.

(10) Patent No.: US 7,698,865 B2
(45) Date of Patent: Apr. 20, 2010

(54) PULTRUDED BUILDING PRODUCT

(75) Inventors: Todd Pringle, West Fargo, ND (US); John Jambois, Fargo, ND (US)

(73) Assignee: Tecton Products, LLC, Fargo, ND (US)

( * ) Notice: Subject to any disclaimer, the term of this patent is extended or adjusted under 35 U.S.C. 154(b) by 1168 days.

(21) Appl. No.: 11/032,315

(22) Filed: Jan. 10, 2005

(65) Prior Publication Data

US 2005/0252139 A1 Nov. 17, 2005

Related U.S. Application Data

(60) Provisional application No. 60/535,702, filed on Jan. 8, 2004.

(51) Int. Cl.
*E04B 1/00* (2006.01)

(52) U.S. Cl. ..... 52/520; 52/529; 52/539; 52/543; 52/544; 52/547

(58) Field of Classification Search ..... 52/518–522, 52/523–527, 529–531, 535–536, 538–544, 52/546–548, 550–551, 578
See application file for complete search history.

(56) References Cited

U.S. PATENT DOCUMENTS 2,988,980 A 6/1961 Tschudin
3,230,995 A 1/1966 Shannon
3,318,056 A 5/1967 Thompson
3,828,510 A * 8/1974 Bettoli ..... 52/548
4,100,710 A 7/1978 Kowallik
4,104,841 A * 8/1978 Naz ..... 52/519
4,122,643 A * 10/1978 Hafner ..... 52/520
4,184,301 A 1/1980 Anderson et al.
4,258,520 A * 3/1981 Rehbein ..... 52/522
4,391,068 A 7/1983 Kosar
4,637,191 A 1/1987 Smith
4,788,088 A 11/1988 Kohl
5,050,362 A * 9/1991 Tal et al. ..... 52/588.1
5,131,200 A 7/1992 McKinnon
5,564,245 A 10/1996 Rademacher
5,617,687 A 4/1997 Bussey et al.
5,694,728 A * 12/1997 Heath et al. ..... 52/554
5,732,520 A 3/1998 Maietta
5,800,651 A 9/1998 Williamson
5,819,486 A * 10/1998 Goodings ..... 52/235
5,878,543 A * 3/1999 Mowery ..... 52/519
6,044,609 A * 4/2000 Kim ..... 52/551

(Continued)

OTHER PUBLICATIONS

U.S. Appl. No. 11/130,828, Non-Final Office Action Mailed Sep. 4, 2007, 9 pgs.

(Continued)

*Primary Examiner*—Jeanette Chapman
(74) *Attorney, Agent, or Firm*—Schwegman, Lundberg & Woessner, P.A.

(57) ABSTRACT

A building product includes a pultruded part that constitutes exterior siding of a building. In one example, the building product includes a pultruded part that constitutes siding and the structural sheathing of a building. In one example, the building product includes a pultruded part that constitutes siding and the structural sheathing of a building and is configured to be weather-tight.

22 Claims, 5 Drawing Sheets

U.S. PATENT DOCUMENTS

| | | | | |
|---|---|---|---|---|
| 6,122,877 | A | 9/2000 | Hendrickson et al. | |
| 6,128,879 | A | 10/2000 | Bussey et al. | |
| 6,197,412 | B1 | 3/2001 | Jambois et al. | |
| 6,293,064 | B1 | 9/2001 | Larson | |
| 6,311,456 | B1 | 11/2001 | Rodero Antunez | |
| 6,314,704 | B1 | 11/2001 | Bryant | |
| 6,341,463 | B1 * | 1/2002 | Dickey et al. | 52/521 |
| 6,355,333 | B1 | 3/2002 | Waggoner et al. | |
| 6,365,081 | B1 * | 4/2002 | Beck | 264/167 |
| 6,401,428 | B1 | 6/2002 | Glover et al. | |
| 6,415,574 | B2 * | 7/2002 | Beck | 52/519 |
| 6,470,638 | B1 | 10/2002 | Larson | |
| 6,515,062 | B2 | 2/2003 | Jesionka | |
| 6,516,580 | B1 | 2/2003 | Maietta | |
| 6,591,567 | B2 | 7/2003 | Hota et al. | |
| 6,594,965 | B2 | 7/2003 | Coulton | |
| 6,637,163 | B2 | 10/2003 | Thibault et al. | |
| 6,871,600 | B2 | 3/2005 | Norton et al. | |
| 6,926,785 | B2 | 8/2005 | Tanzer et al. | |
| 7,114,304 | B2 | 10/2006 | Aota et al. | |
| 7,127,865 | B2 | 10/2006 | Douglas | |
| 7,520,099 | B2 | 4/2009 | Pringle et al. | |
| 2001/0004816 | A1 | 6/2001 | Boyer | |
| 2002/0123288 | A1 | 9/2002 | Davies et al. | |
| 2002/0148382 | A1 | 10/2002 | Norton et al. | |
| 2003/0019175 | A1 | 1/2003 | Kremers | |
| 2003/0136072 | A1 | 7/2003 | Peng | |
| 2004/0182028 | A1 | 9/2004 | Belleau | |
| 2005/0262791 | A1 | 12/2005 | Pringle | |
| 2006/0000170 | A1 | 1/2006 | Pringle et al. | |
| 2006/0096217 | A1 | 5/2006 | Lance et al. | |
| 2009/0094914 | A1 | 4/2009 | Jambois et al. | |

OTHER PUBLICATIONS

U.S. Appl. No. 11/130,828, Response filed Mar. 4, 2008 to Non-Final Office Action mailed Sep. 4, 2007, 9 pgs.
U.S. Appl. No. 11/130,828, Final Office Action mailed Jun. 2, 2008, 14 pgs.
U.S. Appl. No. 11/130,828, Response filed Sep. 2, 2008 to Final Office Action mailed Jun. 2, 2008, 8 pgs.
U.S. Appl. No. 11/130,823, Non-Final Office Action mailed Dec. 18, 2007, 7 pgs.
U.S. Appl. No. 11/130,823, Response filed Mar. 18, 2008 to Non-Final Office Action mailed Dec. 18, 2007, 10 pgs.
U.S. Appl. No. 11/130,823, Final Office Action mailed Jul. 11, 2008, 6 pgs.
Mexican Application Serial No. PA/a/2005/005295, Office Action mailed Jul. 29, 2008, 2 pgs.
U.S. Appl. No. 11/130,823 Notice of Allowance mailed on Dec. 12, 2008, 12 pgs.
U.S. Appl. No. 11/130,828, Advisory Action mailed Sep. 12, 2008, 3 pgs.
"U.S. Appl. No. 11/130,823, Non Final Office Action mailed Mar. 28, 2007", 6 pgs.
"U.S. Appl. No. 11/130,823, Pre-Appeal Brief Request for Review filed Jul. 31, 2008", 5 pgs.
"U.S. Appl. No. 11/130,823, Response filed Jun. 28, 2007 to Non Final Office Action mailed Mar. 28, 2007", 8 pgs.

* cited by examiner

PULTRUDED BUILDING PRODUCT

CROSS-REFERENCE TO RELATED APPLICATION

This application claims the benefit under 35 U.S.C. 119 (e) of U.S. Provisional Application No. 60/535,702 filed on Jan. 8, 2004, which is hereby incorporated by reference in its entirety.

FIELD

This application relates generally to pultruded products and more specifically to a pultruded building product.

BACKGROUND

Siding on residential and light-commercial buildings is typically made of wood, vinyl or metal. Wood is not considered "low maintenance" as it is susceptible to warp, rot, and requires frequent repainting. Both vinyl and metal siding need to be slotted when attached to the sheathing of a home because of their high coefficient of thermal expansion. They have to be carefully nailed in the slots in a manner that allows horizontal movement of the siding as the temperature changes. Warping due to this large CTE is one of the chief drawbacks to these types of siding. Vinyl siding is also susceptible to additional warping because of vinyl's low heat deflection temperature. Solar heat gain on vinyl siding must be minimized to prevent softening of the vinyl, and subsequent warping. The softening of vinyl also occurs simultaneously with a high rate of thermal expansion as the temperature of the vinyl rises, which can make warp and deflection permanent. To reduce solar gain, vinyl siding is typically only sold in light reflecting colors like white and pastels. Dark colors on vinyl siding experience too much solar gain for the vinyl to retain stiffness.

Denting of metal siding results from impacts during installation and regular use. Such denting results from the metal siding being formed from thin-skinned metals that dent easy. Siding products that are more dent resistant result in a better quality siding product. Metal siding, being a good thermal conductor, also reduces the insulating value of the wall and acts as a condensation point for moisture.

Weather barriers are often wrapped around the exterior sheathing of buildings to combat the infiltration of water and air. Installing a weather barrier is a separate step in home construction after the sheathing and before siding installation.

The sheathing on a building, typically OSB (oriented strand board), plywood, polystyrene, or fiberboard, acts as a rigid backing for the internal insulation and the external weather barrier. In the case of OSB or plywood, it also acts as a structural reinforcement to increase the shear strength of a building. Less structural sheathing materials require braces or other additional structural members to give the building the necessary shear strength. Sheathing a building is a separate step from wrapping the weather barrier, and installing the siding.

What is needed is a building product to improve on the disadvantages and weaknesses of traditional siding materials, traditional weather barrier, and traditional sheathing.

SUMMARY

A pultruded product which is adapted to be exterior siding of a building. The pultruded product includes a profile defining a shape of exterior siding and a joint member configured to mate with a joint member of a second pultruded product mounted adjacent the pultruded product.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
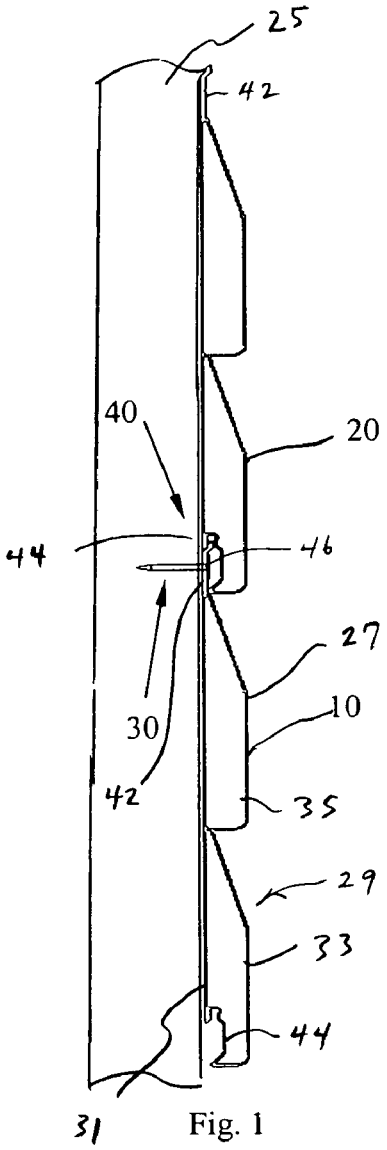
FIG. 1 shows a side view of assembled building products, in accordance with one embodiment.

FIG. 1 shows a side view of assembled building products 10, 20, in accordance with one embodiment. Products 10 and 20 are pultruded products that form the exterior of a building. Products 10, 20 are similar in shape to each other and are described using different numbers for sake of convenience. In one embodiment, products 10 and 20 replace the sheathing, weather barrier, and siding of typical construction. In other words, the pultruded members are configured to be attached directly to a frame 25 of the building and they can have the properties to be exterior siding, a weather-tight barrier, and/or structural sheathing of the building. Accordingly, one or more of these typical building components can be omitted and the time of construction is reduced. Products 10 and 20 are attached to frame 25 of a building with fasteners, such as nails 30 or screws. Thus, for example, a plurality of products 10 and 20 are fastened directly to the 2"×4"s or 2"×6"s used to build the frame of a house. The products 10, 20, are connected at an interlock joint assembly 40, which includes an upper joint member 42 and a lower joint member 44. Each member 10, 20 includes upper and lower joint members 42, 44. A plurality of such members 10, 20 are used to side a building with a series of such members placed adjacent each other. Further details of joint assembly 40 will be discussed below.

The products 10, 20 are formed by pultrusion and can have a wall thickness of about 0.06 inches to about 0.120 inches. Some embodiments have a wall thickness of as small as about 0.03 inches. Some embodiments can have a thickness of about 1 inch or more. The pultrusions can include a coating or a film 27 on at least a portion of the exterior surface of the member for additional protection from elements or ultraviolet protection. For example, the pultrusion and coating can be as described in commonly assigned U.S. Pat. No. 6,197,412, which is incorporated herein by reference in its entirety. Products 10, 20 can be various heights, for example, from three inches or less to 4 feet or more. They can have lengths of up to thirty feet or longer. In this example, the cross-section profile shape of products 10, 20 defines a dutch-lap siding shape. Other continuous cross-section siding shapes are also possible with pultrusion. In some embodiments, these shapes include straight lap, dutch lap, curved lap, beaded, flat, grooved/fluted, and many other profile shapes. Dimension of the lap height are typically three to twelve inches but could be taller or shorter. The number of repeating laps on a given profile are typically one to four but could be many more.

The pultruded products 10, 20 can be formed in virtually any profile shape. Accordingly they can be provided with projecting portions, and other profile shapes, so as to define relief portions 29 on the exterior of the house. For example, each of the pultruded products 10, 20 can include a main body defining a back plane 31 for abutting an outside of the building and one or more sections 33, 35 extending out from the back plane to define relief portions. Accordingly, they can be formed to be aesthetically pleasing such as present siding shapes, as discussed above.

Furthermore, the pultruded products provide protection from wind and rain. Each pultruded member itself is air-tight and weather-tight, and the joint between adjacent members can be sealed to provide an air-tight, rain-tight seal. Moreover, the pultruded products are stiff enough and sturdy enough to provide structural support when attached directly to frame 25. For example, the pultruded products 10, 20 are stiff enough to match or exceed the strength of OSB as sheathing.

Figure 2:
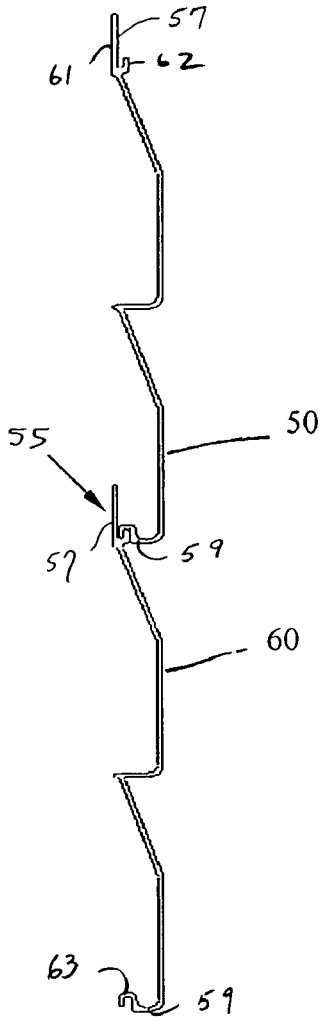
FIG. 2 shows a side view of assembled building products, in accordance with one embodiment.

FIG. 2 shows a side view of assembled building products 50, 60, in accordance with one embodiment. In this embodiment, the assembled member constitute lap siding connected at an interlock joint assembly 55, with each member 50, 60 including an upper joint member 57 and a lower joint member 59. In this example, upper joint member 57 includes a pair of fingers 61, 62 defining a U-shape. Lower joint member 59 includes a curved section 63 defining a U-shape. When assembled, for example, product 60 is fastened to a building through holes in finger 61. U-shaped section 63 is mounted over finger 62 and product 50 is then fastened into place. In some embodiments, a sealing material, such as a gasket, can be placed between joint members 57 and 59.

Figure 3:
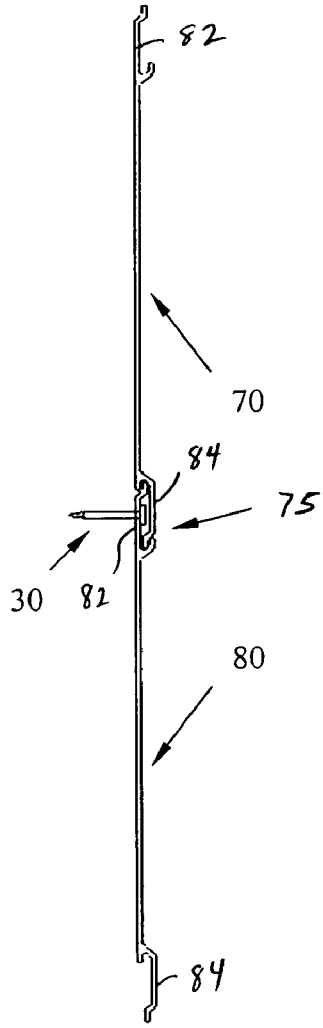
FIG. 3 shows a top view of assembled building products, in accordance with one embodiment.

FIG. 3 shows a side view of assembled building products 70, 80, in accordance with one embodiment. In this embodiment, the assembled members constitute flat siding that could serve as siding only, as sheathing and siding, or as sheathing, siding, and weather-tight barrier. The building products 70, 80, are connected at an interlock joint assembly 75, with each member 70, 80 including an upper joint member 82 and a lower joint member 84.

The present pultruded building products of FIGS. 1-3 are not susceptible to warping due to expansion or softening at elevated temperatures such as vinyl or metal siding. Moreover, they allow for the elimination of installation slots, which makes the present product easier to install, requiring less time and labor. Also, the pultruded members could be installed with any color.

Moreover, since the pultruded members have a relatively high insulative property, they help the insulating value of a structure wall and are less likely to be condensation points for moisture.

In one embodiment, pultruded building products discussed above combine the functionality of sheathing, weather-tight barriers, and/or siding to reduce the labor and time needed to construct a building. The building products offer greater structural support and shear strength to a building versus OSB to allow for a stronger structure, and/or cost savings on other structural members of a building.

As discussed herein, pultrusion is a method of forming composite parts that is automated and continuous. Glass, or other reinforcing fibers, are impregnated with resin and pulled through a forming guide and a heated die. The forming guide orients the fibers to be properly placed in the heated die to insure that the pultruded part has uniform reinforcement across its shape. The heated die cures and/or solidifies the resin around the reinforcing fibers, thus forming the composite part. The composite part, having a profile shape, is continuously pulled out of the heated die by a puller. The puller can be a clamp and stroke action from a reciprocating puller, or a smooth action from a caterpillar puller.

Reinforcing fibers used in the present pultrusion can be glass, carbon fiber, kevlar, and other organic and inorganic filaments and fibers. The most common reinforcement used is glass fibers. Reinforcement fibers can take the form of filament and strand bundles, called rovings. They also take the form of yarns, texturized yams, chopped strand mats, continuous strand mats, knitted mats, woven mats, surfacing veils, and many hybrid combinations of rovings, yams, mats, and veils.

Resin used in pultrusion can be thermosetting resins like unsaturated polyesters in a styrene solution, or polyurethanes, phenolics, epoxides, thermosetting blends, and other thermosetting resins. Other resins used in pultrusion can be thermoplastic resins based on polyurethanes, acrylics, polyethylenes, and other thermoplastic resins. Resin used in pultrusion can also be thermoplastic resins that are embedded in rovings that melt and form the part inside the pultrusion die.

Resin mixtures in pultrusion can also contain organic, polymeric, and inorganic additives for such properties as shrink control, mold lubrication, colorants, fillers and other specially additives.

Glass reinforced pultrusions exhibit very low thermal expansion. Thermosetting pultrusions also exhibit dimensional stability and strength even at high temperatures. Pultrusions can be formulated to offer dent resistance.

Figure 4:
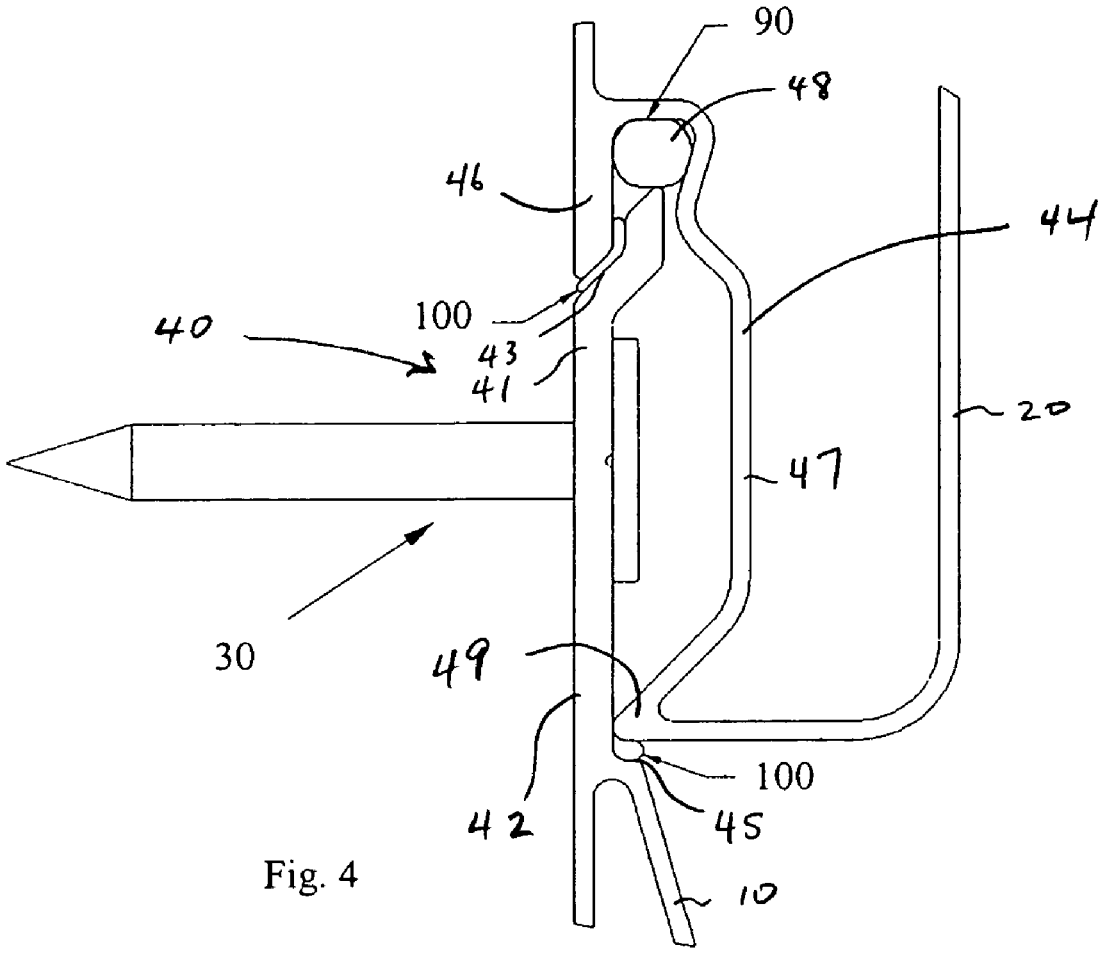
FIG. 4 shows a side view of a joint assembly of the building products of FIG. 1.

FIG. 4 shows a side view of joint assembly 40 of the building products 10, 20. Joint assembly includes upper joint member 42 and lower joint member 44. The terms upper and lower are used herein to describe the relative orientation of the members in view of the Figures. However, in various embodiments, any of the pultruded siding members discussed herein can be mounted horizontally, vertically, or at an angle. Upper joint member includes a finger 41 which extends upwards and outwards to define a shoulder 43. A lower shoulder 45 is formed in a lower portion of joint member 42. Lower joint member 44 includes finger 46 which abuts shoulder 43. An inner wall 47 defines a U-shaped portion 48 and a projection 49. Finger 41 extends into U-shaped portion 48 and projection 49 rests on shoulder 45. Wall 47 is spaced away from finger 41 to provide a space for the head of nail 30. In this example, at least two of the three upper surfaces of finger 41, shoulder 43, and/or shoulder 45 provide support for abutting surfaces of lower joint member 44.

The joint assembly 40 allows for seating of one member to the next. In one embodiment, the interlocking joint assembly 40 also includes sealing members such as foam rope 90 and extruded gaskets 100. The foam and gaskets constitute a multi-point seal to prevent air and rain infiltration providing a weather-tight barrier for the building product system discussed herein.

Figure 5:
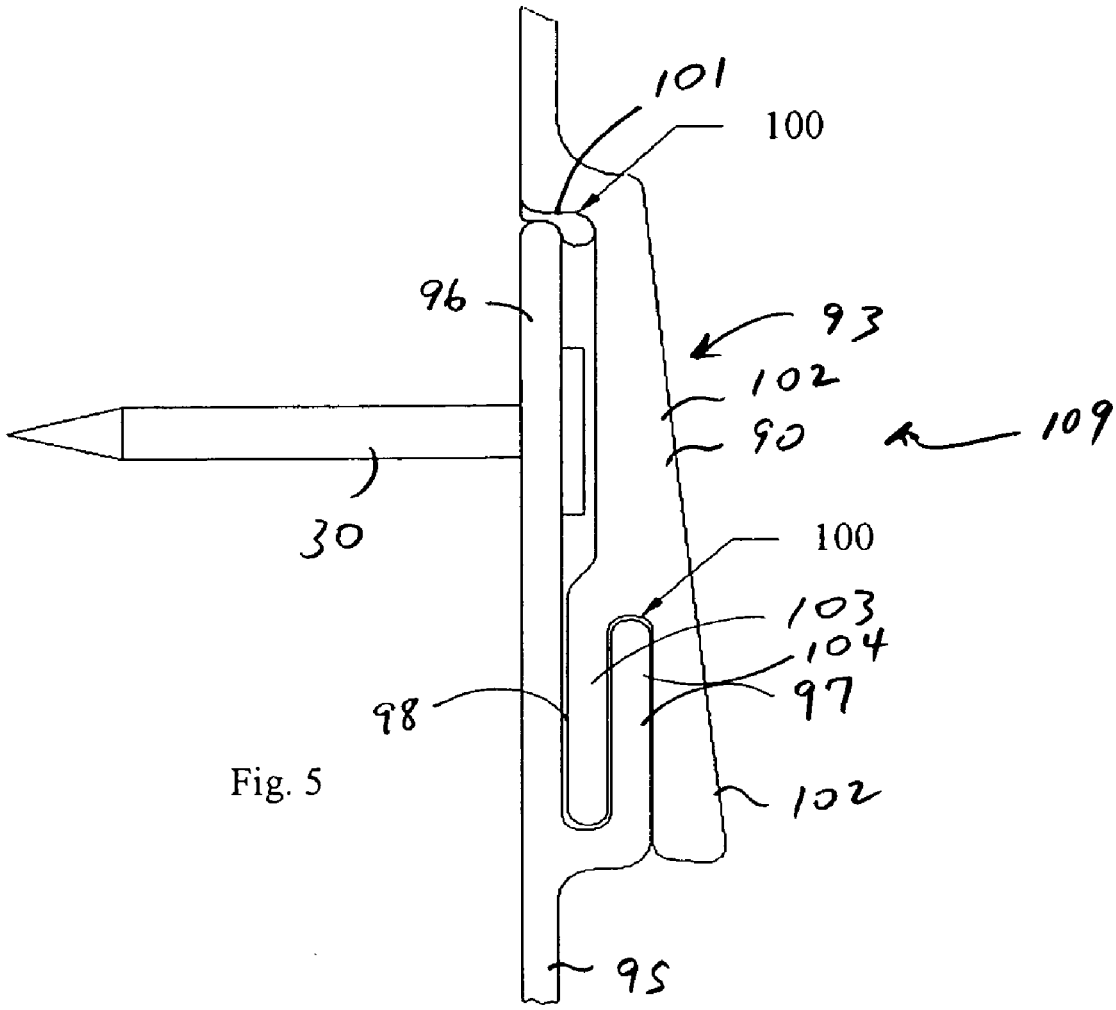
FIG. 5 shows a side view of a joint assembly in accordance with one embodiment.

FIG. 5 shows one embodiment of an interlocking joint assembly 109. In this example, a pair of pultruded members include a lower joint member 90 and an upper joint member 95. Upper joint member 95 includes a first finger 96 and a second finger 97 defining a U-shaped portion 98 therebetween. Fastener 30 can be fastened to a building through a hole in finger 96. Lower joint member 90 includes a curved portion define an upper shoulder 101 and an arm 102 that extends down and divides into a first finger 102 and a second finger 103 that define a U-shaped portion 104. Arm 102 is spaced out from finger 96 to provide a space for the head of fastener 30. When assembled, U-shaped portion 104 envelopes finger 97 while finger 103 extends into U-shaped portion 98. Shoulder 101 abuts the top of finger 96. At least two of the three upper surfaces of finger 96, finger 97 and/or the bottom of U-shaped portion 98 provide support for the downward facing surfaces of shoulder 101, the bottom of U-shaped portion 104, and/or finger 103.

In some embodiments, a sealing member such as gasket material 100 can be provided between the joint members 90 and 95.

Figure 6:
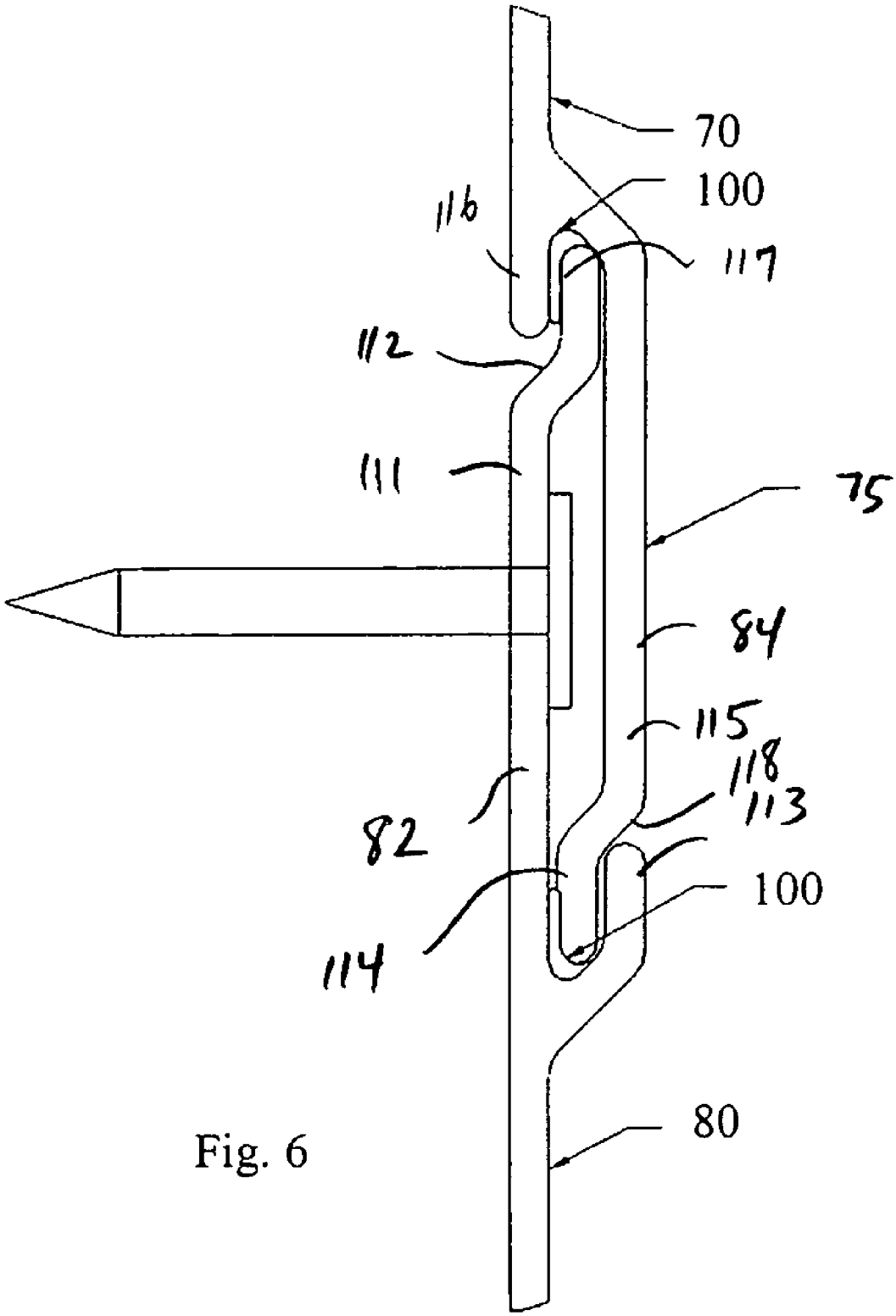
FIG. 6 shows a top view of a joint assembly of the building products of FIG. 3.
Figure 7:
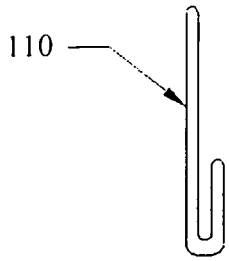
FIG. 7 shows a side view of a trim component for a siding system, in accordance with one embodiment.
Figure 8:
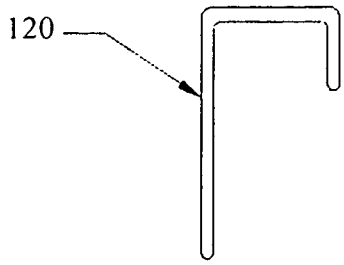
FIG. 8 shows a side view of a trim component for a siding system, in accordance with one embodiment.
Figure 9:
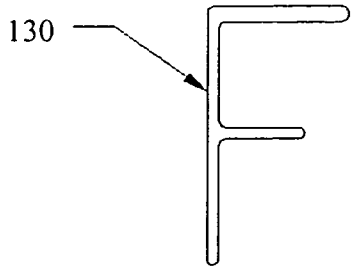
FIG. 9 shows a side view of a trim component for a siding system, in accordance with one embodiment.
Figure 10:
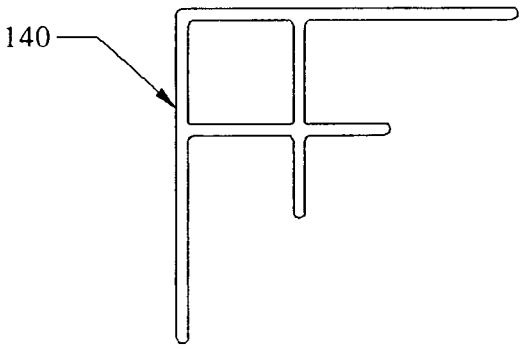
FIG. 10 shows a side view of a trim component for a siding system, in accordance with one embodiment.
Figure 11:
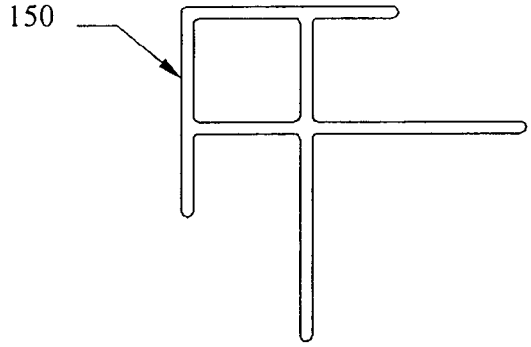
FIG. 11 shows a side view of a trim component for a siding system, in accordance with one embodiment.

FIG. 6 shows a top view of joint assembly 75 of pultruded products 70, 80. In this embodiment, the joint 75 is locking in two places to prevent prying under force. This embodiment is suited for vertically oriented laps, for example. In this embodiment, upper joint member 82 includes a first finger 111 which extends upwards and curves inward defining a shoulder 112. A second finger 113 extends outwards and upwards to define a U-shaped portion or channel 114. Lower joint member 84 includes a first finger 115 which extends into channel 114 and a second finger 116 which defines a U-shaped portion or channel 117. Finger 111 extends into channel 117. Finger 115 includes a shoulder 118. Finger 115 is spaced away from finger 111 to provide space for the head of fastener 30. At least two of the surfaces of joint member 82 contact or abut joint member 84. For example, the surface of shoulder 112, the upper surface of finger 111, the upper surface of finger 113 and/or the bottom of channel 114 can contact the corresponding shoulders and fingers of the corresponding joint member 84. In one example, a sealing member, such as gasket material 100 is provided.

Referring again to FIG. 1, 2, or 3, in use, a plurality of pultruded products 10, 20 (or 50, 60, or 70, 80) are provided. Starting at a bottom of the building a first product 10 is fastened directly to the frame of the building. The fasteners can be nailed all the way into the frame through the pultruded product, for example through finger 41 of joint member 42. In some embodiments, one or more guiding or mounting holes 46 can be provided in the pultruded product. For example, the holes can be located through finger 42. This is in contrast to how vinyl siding is hung. Vinyl siding is loosely hung through elongate slots in the siding. This is because of the high CTE of vinyl. (Typically about $33\times10^{-6}$ in/in/F). In contrast, the pultruded products of the present system have a CTE of about $4\times10^{-6}$ in/in/F or less. In various embodiments, the CTE can be from about 3 to about $5\times10^{-6}$ in/in/F. This allows them to be tightly fastened to the frame because there is no danger of them expanding enough to come loose. Tightly fastening the pultruded members to the building also provides for a sturdy structure to replace the traditional sheathing of a building.

After product 10 is mounted to the building, the second product 20 is placed adjacent the first product such that joint 42 mates with joint 44. In this example, at least two points of support are provided between the upper and lower joints. One embodiment provides a sealing material on all the abutting surfaces so as to provide a three-point (or more) seal. The joint members are further designed such that the lower joint covers the fastener 30 of the lower product. After the upper product is fastened to the frame, the process is repeated.

In various examples, the pultruded products can be made having profiles defining the following siding styles: straight lap, curved lap, dutch lap, flat, beaded, fluted, reeded, or smooth siding. In one or more examples, a pultruded part can contain one or more repeating siding features per part. In some embodiments, any of the pultruded products discussed can be used as horizontal siding, vertical siding, or angled siding.

FIGS. 7-11 show embodiments of some trim components for assembly of the present system onto a structure. These components include starter strips 110, j-channel 120, f-channel 130, inside corners 140, and outside corners 150. For example, starter strip 110 can include a shape defining an upper joint portion to mate with the lower joint portion 84 (FIG. 5) of one or more of the plurality of pultruded products discussed above. Starter strip 110 can be used as the first element when siding a building, with the pultruded products (such as product 80) then added to it. J-channel 120 is used when a siding member meets a window or door. F-channel 130 is used when a siding member meets a soffit. Inside corner 140 and outside corner 150 are for inside and outside corners where one wall of siding meets another wall of siding.

The pultruded building products discussed herein can be designed in various manners. For example, a building product can include a pultruded part that constitutes exterior siding of a building. Also a building product can include a pultruded part that constitutes siding and a weather-tight barrier. Also a building product can include a pultruded part that constitutes siding and the external and structural sheathing of a building. Some embodiments provide exterior siding, sheathing, and a weather-tight barrier. In some embodiments, a building product can include a pultruded part that constitutes the necessary attachments, trim, and accessories for installing siding, weather barrier, and sheathing.

The present pultruded building products offer the low thermal expansion that vinyl and metal siding lacks. Pultruded products can be formulated to exhibit dent resistance that metal siding lacks. Pultruded products are thermal insulators while metal siding is thermally conductive. Pultruded products do not soften due to solar heat gain, even in very dark colors, unlike vinyl siding. Moreover, pultruded products can be designed and formulated to have superior structural properties in terms of actual strengths and strength-to-weight ratios compared to traditional sheathing products like plywood or OSB.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A building product comprising:

a pultruded product adapted to be exterior siding of a building, the pultruded product having a profile defining a shape of exterior siding and a lower joint member at a bottom of the pultruded product, the lower joint member configured to mate with an upper joint member disposed at a top of a second pultruded product mounted adjacent the pultruded product, the upper joint member including a fastening surface configured to abut the building and accept a fastener through the fastening surface with fastening of the pultruded product to the building, wherein the lower joint member includes a substantially downwardly-opening U-shaped portion and the upper joint member includes a substantially upwardly-extending finger configured to extend upwardly into the U-shaped portion, the upwardly-extending finger being disposed on a first side of the upper joint member above the fastening surface of the pultruded product, the upper joint member including a first abutment portion disposed on a second side of the upper joint member below the fastening surface, the first abutment portion configured to abut a second abutment surface of the lower joint member.

2. The building product of claim 1, wherein the pultruded product include a weather resistance finish on an exterior surface of the product.

3. The building product of claim 1, further including a seal member located proximate the lower joint member or the upper joint member.

4. A building product comprising:

a pultruded product configured to be attached to an outside of a building and having properties so as to be an integral building product capable of being exterior siding and structural sheathing of the building, wherein the pultruded product includes a lower joint member at a bottom of the pultruded product, the lower joint member configured to mate with an upper joint member disposed at a top of a second pultruded product mounted adjacent the pultruded product, the upper joint member including a fastening surface configured to abut the outside of the building and accept a fastener through the fastening surface with fastening of the pultruded product to the building, wherein the lower joint member includes a substantially downwardly-opening U-shaped portion and the upper joint member includes a substantially upwardly-extending finger configured to extend upwardly into the U-shaped portion, the upwardly-extending finger being disposed on a first side of the upper joint member above the fastening surface of the pultruded product, the upper joint member including a first abutment portion disposed on a second side of the upper joint member below the fastening surface, the first abutment portion configured to abut a second abutment surface of the lower joint member, wherein, with the lower joint member engaged with the upper joint member and the second pultruded product fastened to the building, the lower joint member wraps around the fastener through the fastening surface of the upper joint member, the fastener disposed between the U-shaped portion and the second abutment surface.

5. The building product of claim 4, wherein the pultruded product includes a main body defining a back plane for abutting an outside of the building, wherein the pultruded product includes one or more sections extending out from the back plane to define relief portions.

6. The building product of claim 4, wherein the pultruded product has a coefficient of thermal expansion of from about $3\times10^{-6}$ in/in/F to about $5\times10^{-6}$ in/in/F.

7. A siding system comprising:

a plurality of pultruded products, each having a first, upper joint member at a top of the pultruded product and a second, lower joint member at a bottom of the pultruded product;

wherein the plurality of pultruded products are configured to be mounted to an outside of a building with at least one lower pultruded product mounted to the outside of the building and at least one upper pultruded product mounted above the lower pultruded product such that the lower joint member of the upper pultruded product is mated to and supported by the upper joint member of the lower pultruded product, wherein the upper joint member includes a fastening surface configured to abut the outside of the building and accept a fastener through the fastening surface with fastening of the pultruded product to the building, and the lower joint member of the upper pultruded product includes a substantially downwardly-opening U-shaped portion and the upper joint member of the lower pultruded product includes a substantially upwardly-extending finger configured to extend upwardly into the U-shaped portion, the upwardly-extending finger being disposed on a first side of the upper joint member above the fastening surface of the pultruded product, the upper joint member including a first abutment portion disposed on a second side of the upper joint member below the fastening surface, the first abutment portion configured to abut a second abutment surface of the lower joint member, wherein the lower joint member includes a portion that abuts the outside of the building with the pultruded product mounted to the outside of the building.

8. The siding system of claim 7, wherein the upper joint member of the lower pultruded product includes at least two surfaces that provide vertical support to the upper pultruded product.

9. The siding system of claim 7, wherein the finger extends substantially parallel to a back plane of the pultruded product.

10. The siding system of claim 9, wherein a portion of the finger is spaced from the outside of the building.

11. The siding system of claim 7, wherein the upper joint member includes a shoulder for supporting a downward facing surface of the upper pultruded product.

12. The siding system of claim 7, wherein each of the pultruded products include a portion extending outward from the outside of the building to define a relief portion of the siding system.

13. The siding system of claim 7, including a gasket material between the upper joint member and the lower joint member.

14. The siding system of claim 7, wherein each of the pultruded products has a coefficient of thermal expansion of from about $3\times10^{-6}$ in/in/F to about $5\times10^{-6}$ in/in/F.

15. The siding system of claim 7, wherein each of the pultruded products is stiff enough to be directly attached to a frame of the building to act as a structural support.

16. The siding system of claim 7, further including a starter strip having an upper joint portion to mate with the lower joint portion of one of the plurality of pultruded products.

17. The siding system of claim 7, wherein the upper joint and the lower joint define a three-point seal between adjacent pultruded members.

18. A method comprising:

fastening a first pultruded product to an outside of a building; and fastening a second pultruded product to the outside of the building adjacent the first pultruded product with a lower joint member at a bottom of the second pultruded product mating with an upper joint member at a top of the first pultruded product, wherein the upper joint member includes a fastening surface configured to abut the outside of the building and accept a fastener through the fastening surface with fastening of the first pultruded product to the building, and the lower joint member of the second pultruded product includes a substantially downwardly-opening U-shaped portion and the upper joint member of the first pultruded product includes a substantially upwardly-extending finger configured to extend upwardly into the U-shaped portion, the upwardly-extending finger being disposed on a first side of the upper joint member above the fastening surface of the pultruded product, the upper joint member including a first abutment portion disposed on a second side of the upper joint member below the fastening surface, the first abutment portion configured to abut a second abutment surface of the lower joint member.

19. The method of claim 18, wherein fastening includes fastening the first pultruded product directly to a frame of the building.

20. The method of claim 18, wherein the pultruded product is adapted to be external siding of the building.

21. The method of claim 18, wherein the pultruded product is stiff enough to act as structural sheathing and external siding for the building.

22. The method of claim 21, wherein the pultruded product also acts as air-tight and water-tight barrier for the building.

* * * * *